US009357310B2

(12) United States Patent
Tang et al.

(10) Patent No.: US 9,357,310 B2
(45) Date of Patent: May 31, 2016

(54) FULL-AUDIO-RANGE SPEAKER

(71) Applicant: KINGSTATE ELECTRONICS CORPORATION, New Taipei (TW)

(72) Inventors: Chia-Yuan Tang, New Taipei (TW); Chia-Chang Wang, New Taipei (TW)

(73) Assignee: Kingstate Electronics Corporation, New Taipei (TW)

( * ) Notice: Subject to any disclaimer, the term of this patent is extended or adjusted under 35 U.S.C. 154(b) by 338 days.

(21) Appl. No.: 14/151,616

(22) Filed: Jan. 9, 2014

(65) Prior Publication Data

US 2014/0307912 A1 Oct. 16, 2014

(30) Foreign Application Priority Data

Apr. 16, 2013 (TW) ..... 102206883 U

(51) Int. Cl.
*H04R 1/02* (2006.01)
*H04R 7/04* (2006.01)
*H04R 1/26* (2006.01)

(52) U.S. Cl.
CPC . *H04R 7/045* (2013.01); *H04R 1/26* (2013.01)

(58) Field of Classification Search
CPC ..... H04R 1/02; H04R 1/025; H04R 1/22; H04R 1/26; H04R 7/045; H04R 2201/02
USPC ..... 381/152, 182, 184, 345, 386, 431; 181/198, 199
See application file for complete search history.

(56) References Cited

U.S. PATENT DOCUMENTS 3,815,707 A * 6/1974 Burhoe ..... H04R 1/2819 181/199
4,514,599 A * 4/1985 Yanagishima ..... H04R 1/24 381/152
6,738,489 B2 * 5/2004 Chung ..... H04R 9/06 340/407.1
7,194,099 B2 * 3/2007 Lewis ..... H04M 1/03 381/182
2013/0251176 A1 * 9/2013 Goto ..... H04R 1/00 381/152

* cited by examiner

*Primary Examiner* — Ahmad F Matar
*Assistant Examiner* — Katherine Faley
(74) *Attorney, Agent, or Firm* — Muncy, Geissler, Olds & Lowe, P.C.

(57) ABSTRACT

A full-audio-range speaker has a box, at least one dynamic speaker unit, and a vibration speaker. The box has multiple side walls and at least one wall hole. The at least one dynamic speaker unit is mounted in the box and has a sound hole aligned with the at least one wall hole. The vibration speaker is mounted through the box. The at least one dynamic speaker unit and the vibration speaker respectively improve midrange, treble, and bass performances of the full-audio-range speaker. Therefore, the full-audio-range speaker can have relatively good midrange, treble, and bass performances simultaneously.

20 Claims, 10 Drawing Sheets

FULL-AUDIO-RANGE SPEAKER

BACKGROUND OF THE INVENTION

1. Field of the Invention

The present invention relates to a speaker and more particularly to a full-audio-range speaker that is capable of full audio range performance in the bass, midrange, and treble frequency regions.

2. Description of Related Art

Speakers are devices for transforming electronic signals into sounds, wherein dynamic speakers are one of the most common types of the speakers. A dynamic speaker comprises a dynamic speaker unit and a box. The dynamic speaker unit is mounted in the box and has a coil, a magnet and a diaphragm, wherein the coil, the magnet and the diaphragm are stacked together. When the dynamic speaker receives an audio signal, the coil generates a magnetic field based on the audio signal. The coil is attracted or repulsed by the magnet and vibrates. The diaphragm vibrates with the coil and causes an air vibration to generate sounds. The box resonates with the sounds and enhances bass performance.

Generally, the bass performance of the dynamic speaker depends on a volume of the box. The bass performance of the dynamic speaker can be improved by expanding the volume of the box. However, when the volume of the box is too large, the dynamic speaker is hard to move or store, hence causing inconvenience to users. Therefore, most dynamic speakers are manufactured small and have poor bass performances.

Vibration speakers are another type of the speakers, and a vibration speaker comprises a coil and a magnet. When using the vibration speaker, the vibration speaker has to firmly contact a medium, such as a wooden table, glass, wall, metal, etc. The vibration speaker receives an audio signal, and the coil generates a magnetic field based on the audio signal. The coil is attracted or repulsed by the magnet and vibrates, thereby making the vibration speaker vibrate. The medium contacted with the vibration speaker also vibrates and causes an air vibration to generate sounds.

Generally, sound effect of the vibration speaker depends on the medium that contacts the vibration speaker. When the medium is a wooden table, glass, wall or metal, bass performance of the vibration speaker is relatively good, but midrange and treble performances of the vibration speaker are relatively poor. When the medium is stone or the ground, the midrange and the treble performances of the vibration speaker are relatively good, but the bass performance of the vibration speaker is poor.

In conclusion, the vibration speaker does not have a box compared to the dynamic speaker, thus, a volume of the vibration speaker is usually smaller than a volume of the dynamic speaker. Disadvantage of the vibration speaker is that the vibration speaker cannot have good bass, midrange and treble performances at the same time.

SUMMARY OF THE INVENTION

The main objective of the invention is to provide a full-audio-range speaker capable of full audio range performance in the bass, midrange, and treble frequency regions at the same time.

The full-audio-range speaker comprises a box, at least one dynamic speaker unit, and a vibration speaker. The box has multiple side walls and at least one wall hole formed through one of the multiple side walls. The at least one dynamic speaker unit is mounted in the box, wherein the at least one dynamic speaker unit has a sound hole aligned with the at least one wall hole. The vibration speaker is mounted through the box and has a T-shaped base. The T-shaped base has a pillar and a bottom board, wherein the pillar is mounted through one of the multiple side walls that does not have the at least one wall hole and has two ends respectively located inside and outside the box. The bottom board is connected to one of the two ends of the pillar that is outside the box.

The full-audio-range speaker in accordance with the present invention is adapted for being electrically connected to an audio device and mounted on a medium. When the audio device outputs an audio signal to the audio device, the at least one dynamic speaker unit receives the audio signal and generates sounds based on the audio signal, and the vibration speaker also receives the audio signal and vibrates based on the audio signal. The medium vibrates with the vibration speaker causing an air vibration to generate sounds.

When a user of the full-audio-range speaker needs to emphasize bass performance of the full-audio-range speaker, the user can choose glass, wall or metal as the medium for contact with the full-audio-range speaker, thus, the vibration speaker of the full-audio-range speaker can have better bass performance, so as to improve the overall bass performance of the full-audio-range speaker. Simultaneously, the full-audio-range speaker can also have good midrange and treble performances by the at least one dynamic speaker unit.

In conclusion, the full-audio-range in accordance with the present invention has good performance in all audio ranges by the at least one dynamic speaker unit and the vibration speaker. Furthermore, the bass performance of the full-audio-range speaker is improved by the vibration speaker, and the at least one dynamic speaker unit only needs to focus on midrange and treble performances, that is, the full-audio-range speaker can have good bass performance with a relatively small box compared to a conventional dynamic speaker. Therefore, the full-audio-range speaker can be further decreased in volume and can be easily stored and carried by a user.

DETAILED DESCRIPTION OF THE PREFERRED EMBODIMENTS

Figure 1:
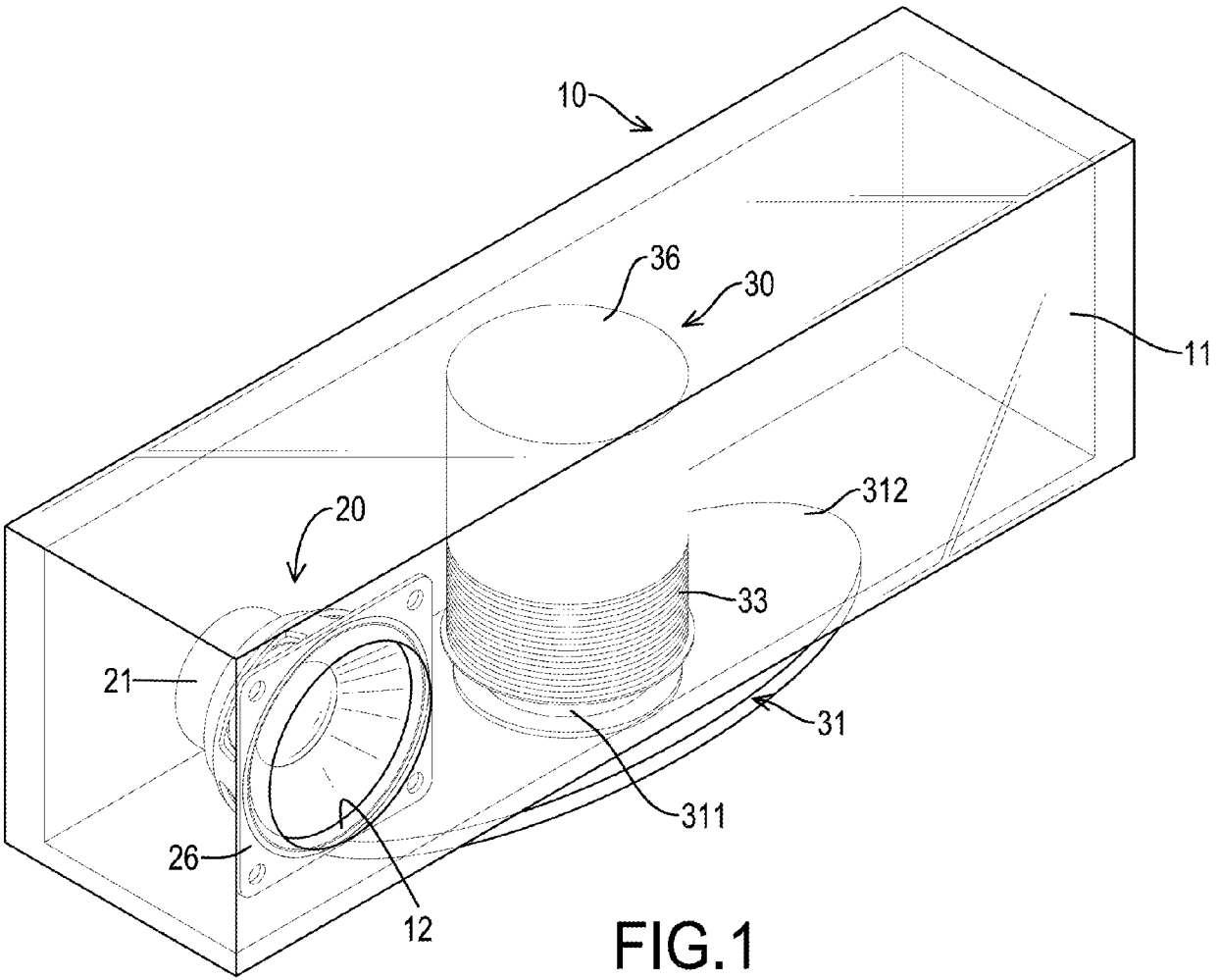
FIG. 1 is a perspective view of a first preferred embodiment of a full-audio-range speaker in accordance with the present invention.

With reference to FIG. 1, a first preferred embodiment of a full-audio-range speaker in accordance with the present invention comprises a box 10, a dynamic speaker unit 20 and a vibration speaker 30.

The box 10 is a rectangle and has multiple side walls 11 and a wall hole 12, wherein the wall hole 12 is formed through one of the multiple side walls 11.

Figure 2:
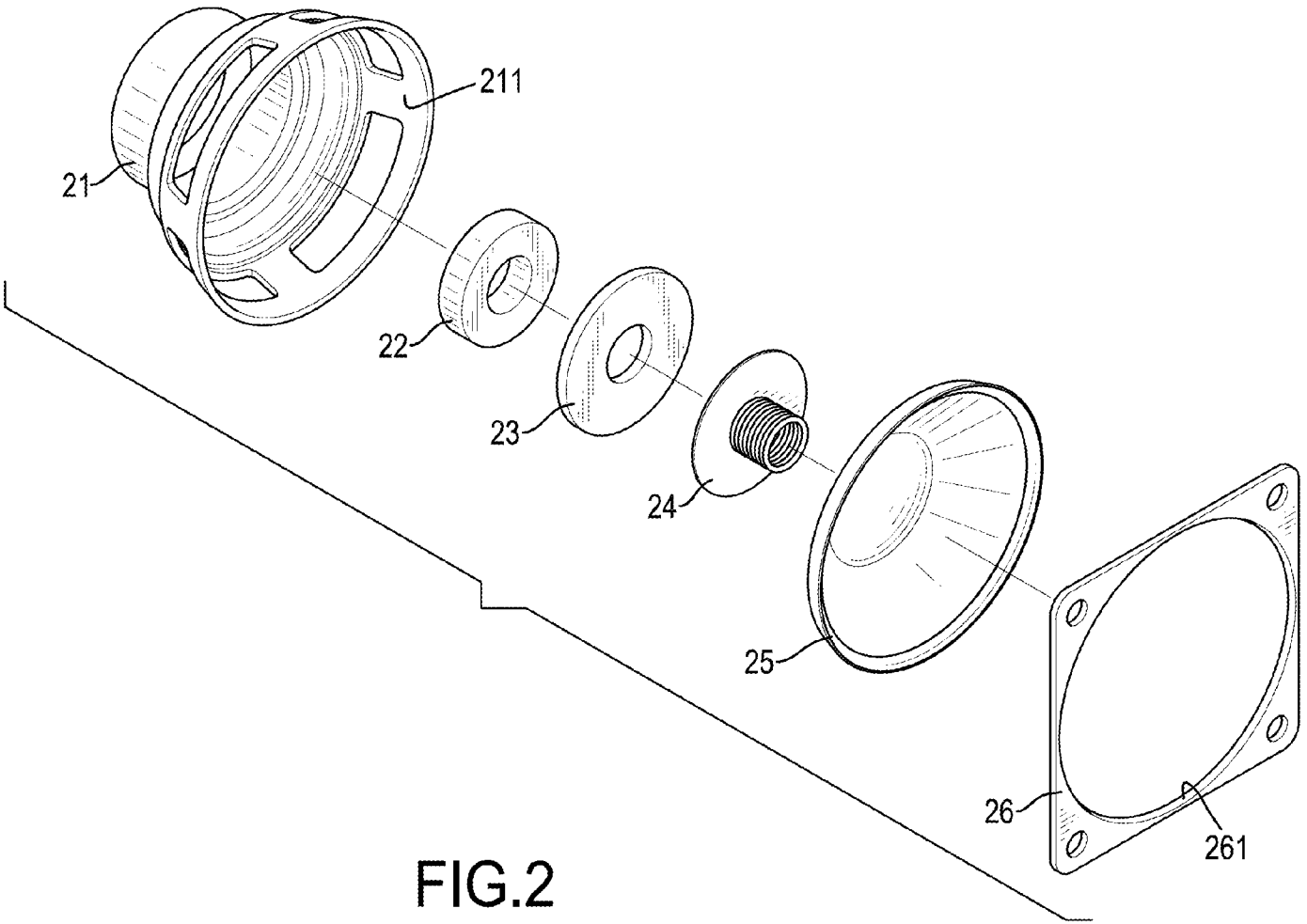
FIG. 2 is an exploded view of a dynamic speaker unit of the full-audio-range speaker in FIG. 1.

With reference to FIGS. 1 and 2, the dynamic speaker unit 20 is mounted in the box 10 and has a speaker housing 21, a first magnet 22, a first magnetoconductive plate 23, a first coil 24, a diaphragm basin 25 and a fixing board 26.

The speaker housing 21 has a first end 211, a second end 212 and a sound hole 213, wherein the sound hole 213 is formed at the first end 211 and aligned with the wall hole 12 of the box 10.

The first magnet 22 is mounted in the second end 212 and has a first surface and a second surface, wherein the first surface of the first magnet 22 faces toward the sound hole 213.

The first magneto conductive plate 23 is mounted in the second end 212 and is located above the first magnet 22, wherein the first magneto conductive plate 23 has a first surface and a second surface. The first surface of the first magneto conductive plate 23 faces toward the sound hole 213, and the second surface of the first magneto conductive plate 23 faces toward the first surface of the first magnet 22 to increase speed of magnetic conduction and sensitivity of magnetization.

The first coil 24 is mounted on the first surface of the first magnetoconductive plate 23 and adapted for being electrically connected to an external audio device. The first coil 24 receives audio signals from an external audio device and generates a magnetic field based on the audio signals, and then the first coil 24 is attracted or repulsed by the first magnet 22 and vibrates.

The diaphragm basin 25 is mounted in the speaker housing 21 and on the first coil 24. When the first coil 24 vibrates, the diaphragm basin 25 vibrates with the first coil 24, causing an air vibration to generate sounds.

The fixing board 26 is mounted on one of the multiple side walls 11 of the box 10 that has the wall hole 12, and the fixing board 26 has a fixing hole 261 aligned with the wall hole 12. An inner diameter of the fixing hole 261 is larger than an outer diameter of the diaphragm basin 25, such that the diaphragm basin 25 is mounted in the fixing hole 261 to fix the dynamic speaker unit 20 in the box 10.

Figure 3:
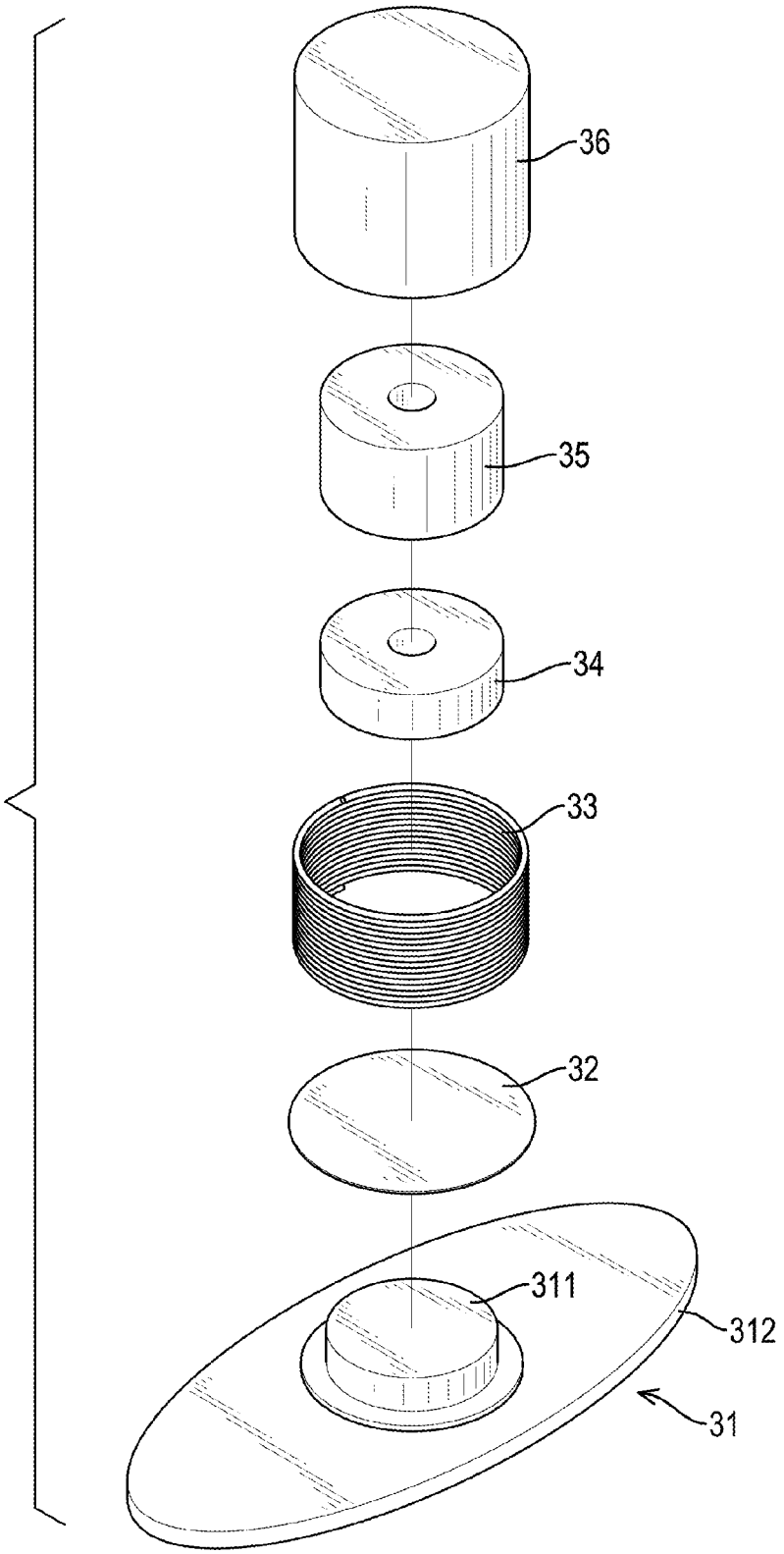
FIG. 3 is an exploded view of a vibration speaker of the full-audio-range speaker in FIG. 1.

With reference to FIGS. 1 and 3, the vibration speaker 30 has a T-shaped base 31, a flexible metal panel 32, a second coil 33, a second magneto conductive plate 34, a second magnet 35 and a metal cap 36.

The T-shaped base 31 has a pillar 311 and a bottom board 312. The pillar 311 is mounted through one of the multiple side walls 11 that does not have the wall hole 12, and the pillar 311 has two ends respectively located inside and outside the box 10. The bottom board 312 is connected to one of the two ends of the pillar 311 that is outside the box 10, wherein the bottom board 312 is adapted for contact with a medium.

The flexible metal panel 32 is mounted on one of the two ends of the pillar 311 that is inside the box 10. The flexible metal panel 32 is made of flexible metal, thus, the flexible metal panel 32 can increase vibration amplitude of the vibration speaker 30 to transfer vibration force to the medium effectively.

The second coil 33 is mounted on the flexible metal panel 32 and adapted for being electrically connected to the external audio device. The second coil 33 receives audio signals from the external audio device and generates a magnetic field based on the audio signals.

The second magneto conductive plate 34 is mounted in the second coil 33 to increase speed of magnetic conduction and sensitivity of magnetization.

The second magnet 35 is mounted in the second coil 33 and on the second magneto conductive plate 34. When the second coil 33 generates a magnetic field, the second coil 33 and the second magnet 35 interact and generate the vibration force in an axial direction of the pillar 311.

The metal cap 36 is mounted on the second coil 33 to increase a weight of the vibration speaker 30. Thus, the bottom board 312 contacts the medium relatively tighter due to the increased weight of the vibration speaker 30 to transfer vibration force to the medium effectively.

Figure 4A:
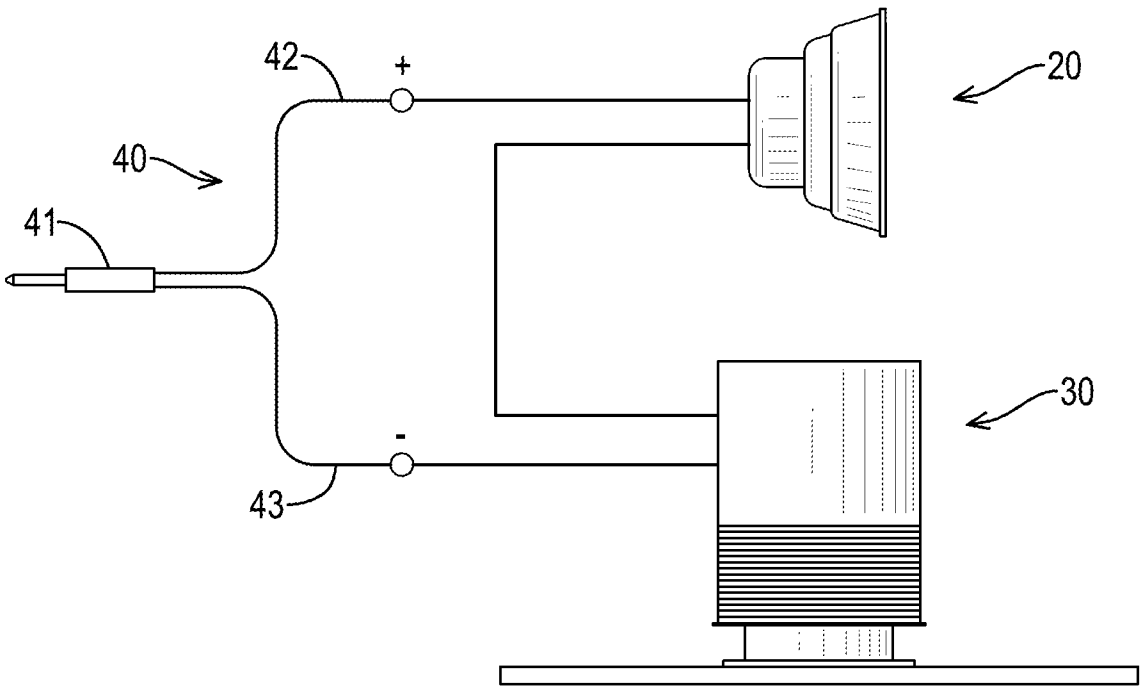
FIG. 4A is a circuit diagram of the full-audio-range speaker in FIG. 1 having an audio cable.
Figure 4B:
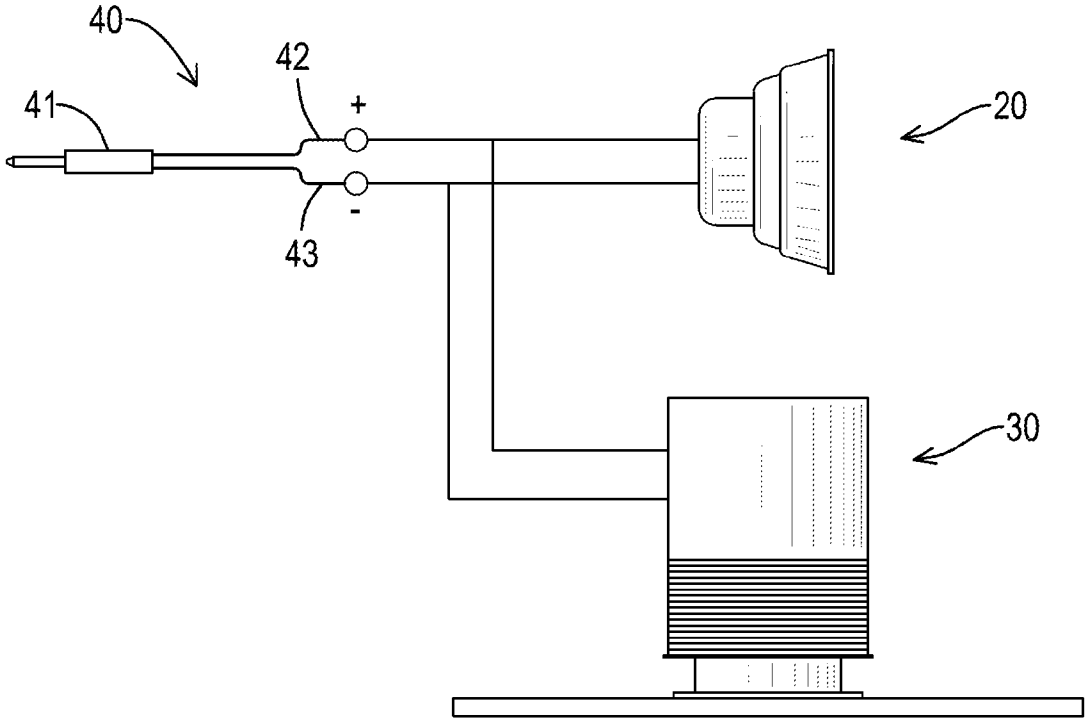
FIG. 4B is another circuit diagram of the full-audio-range speaker in FIG. 1 having an audio cable.

In order to be compatible with a mobile device such as a cell phone, a MP3 or a handheld video game device having only an audio port, with reference to FIGS. 4A and 4B, the first preferred embodiment of the full-audio-range speaker in accordance with the present invention further comprises an audio cable 40 having an audio connecter 41, a signal cable 42 and a ground cable 43.

With reference to FIG. 4A, a connection between the dynamic speaker unit 20, the vibration speaker 30 and the audio cable 40 is shown, and the dynamic speaker unit 20 and the vibration speaker 30 each have a signal terminal and a ground terminal. The signal cable 42 is electrically connected to the audio connecter 41 and the signal terminal of the dynamic speaker unit 20. The ground terminal of the dynamic speaker unit 20 is electrically connected to the signal terminal of the vibration speaker 30. The ground cable 43 is electrically connected to the audio connecter 41 and the ground terminal of the vibration speaker 30, that is, the dynamic speaker unit 20 and the vibration speaker 30 are connected in series.

With reference to FIG. 4B, another connection between the dynamic speaker unit 20, the vibration speaker 30 and the audio cable 40 is shown. The signal cable 42 is electrically connected to the audio connecter 41, the signal terminal of the dynamic speaker unit 20, and the signal terminal of the vibration speaker 30. The ground cable 43 is electrically connected to the audio connecter 41, the ground terminal of the dynamic speaker unit 20, and the ground terminal of the vibration speaker 30, that is, the dynamic speaker unit 20 and the vibration speaker 30 are connected in parallel.

Figure 4C:
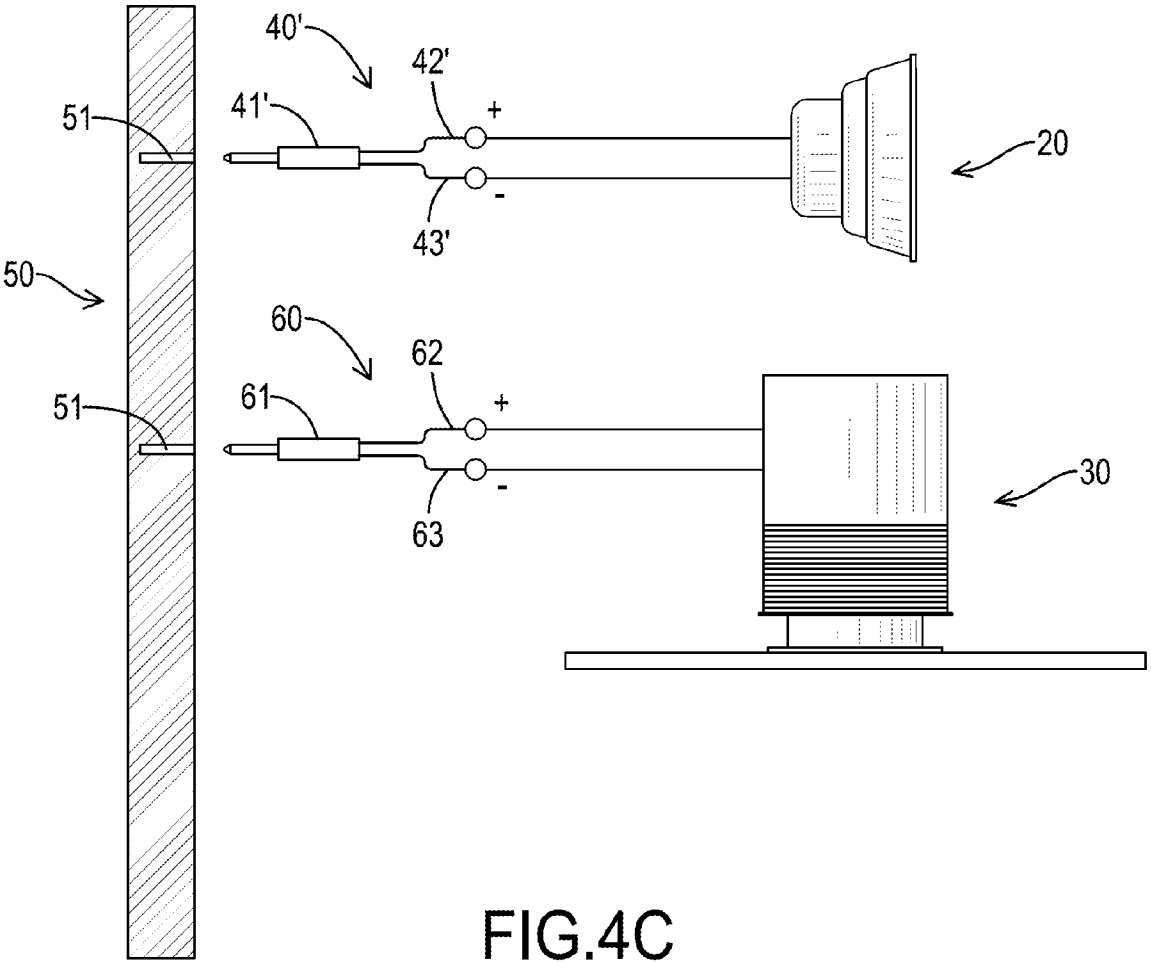
FIG. 4C is a circuit diagram of the full-audio-range speaker in FIG. 1 having two audio cables.

Furthermore, a dual-audio device 50 (1.1 audio interface) is shown in FIG. 4C and has two audio ports 51 to output sounds in dual audio channels. In order to be compatible with the dual-audio device 50, the first preferred embodiment of the full-audio-range speaker in accordance with the present invention further comprises a first audio cable 40' and a second audio cable 60.

The first audio cable 40' has an audio connecter 41', a signal cable 42' and a ground cable 43'. The signal cable 42' is electrically connected to the audio connecter 41' and the signal terminal of the dynamic speaker unit 20. The ground cable 43' is electrically connected to the audio connecter 41' and the ground terminal of the dynamic speaker unit 20.

The second audio cable 60 has an audio connecter 61, a signal cable 62 and a ground cable 63. The signal cable 62 is electrically connected to the audio connecter 61 and the signal terminal of the vibration speaker 30. The ground cable 63 is electrically connected to the audio connecter 61 and the ground terminal of the vibration speaker 30.

By the first audio cable 40' and the second audio cable 60, the dynamic speaker unit 20 and the vibration speaker 30 can respectively receive audio signals from the two audio ports 51 of the dual-audio device 50 to respectively generate sounds in dual audio channels.

As shown from the above paragraphs, when the first preferred embodiment of the full-audio-range speaker in accordance with the present invention contacts the medium, the vibration speaker 30 has a relatively good bass performance, such that the dynamic speaker unit 20 and the vibration speaker 30 respectively improve midrange, treble, and bass performances of the full-audio-range speaker. Therefore, the full-audio-range speaker can have relatively good midrange, treble, and bass performances simultaneously compared to a conventional dynamic speaker or a conventional vibration speaker.

Figure 5:
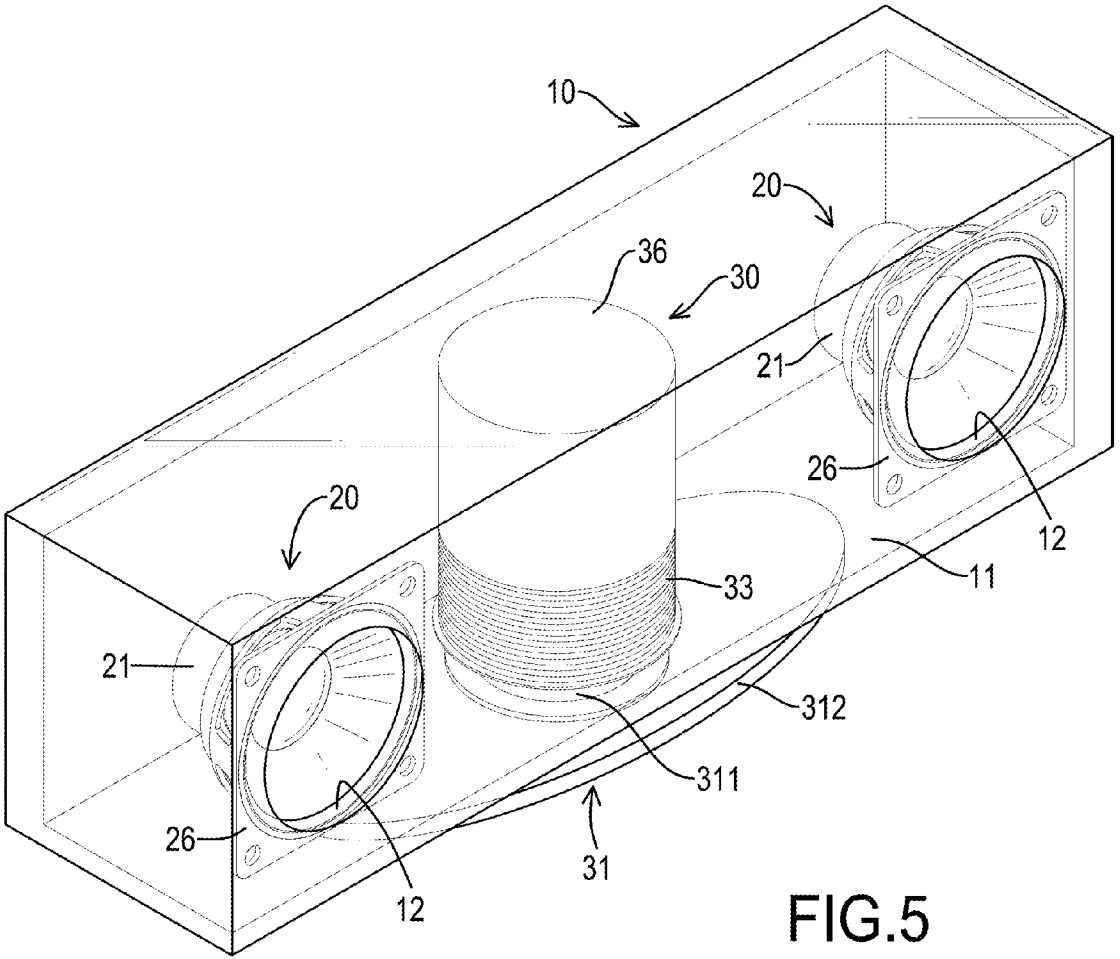
FIG. 5 is a perspective view of a second preferred embodiment of a full-audio-range speaker in accordance with the present invention.

With reference to FIG. 5, a second preferred embodiment of a full-audio-range speaker in accordance with the present invention comprises a box 10, two dynamic speaker units 20 and a vibration speaker 30. With reference to FIGS. 1 and 5, a structure of the two dynamic speaker units 20 and the vibration speaker 30 in the second preferred embodiment and a structure of the dynamic speaker unit 20 and the vibration speaker 30 in the first preferred embodiment are same. Therefore, descriptions related to the structure of the two dynamic speaker units 20 and the vibration speaker 30 will not be repeated in following paragraphs.

The box 10 has multiple side walls 11 and two wall holes 12 formed through one of the multiple side walls 11, wherein the two wall holes 12 are formed through both sides of said one of the side walls 11 and two sound holes 213 of the two dynamic speaker units 20 are respectively aligned with the two wall holes 12. The vibration speaker 30 is mounted through the box 10 and between the two dynamic speaker units 20.

Figure 6A:
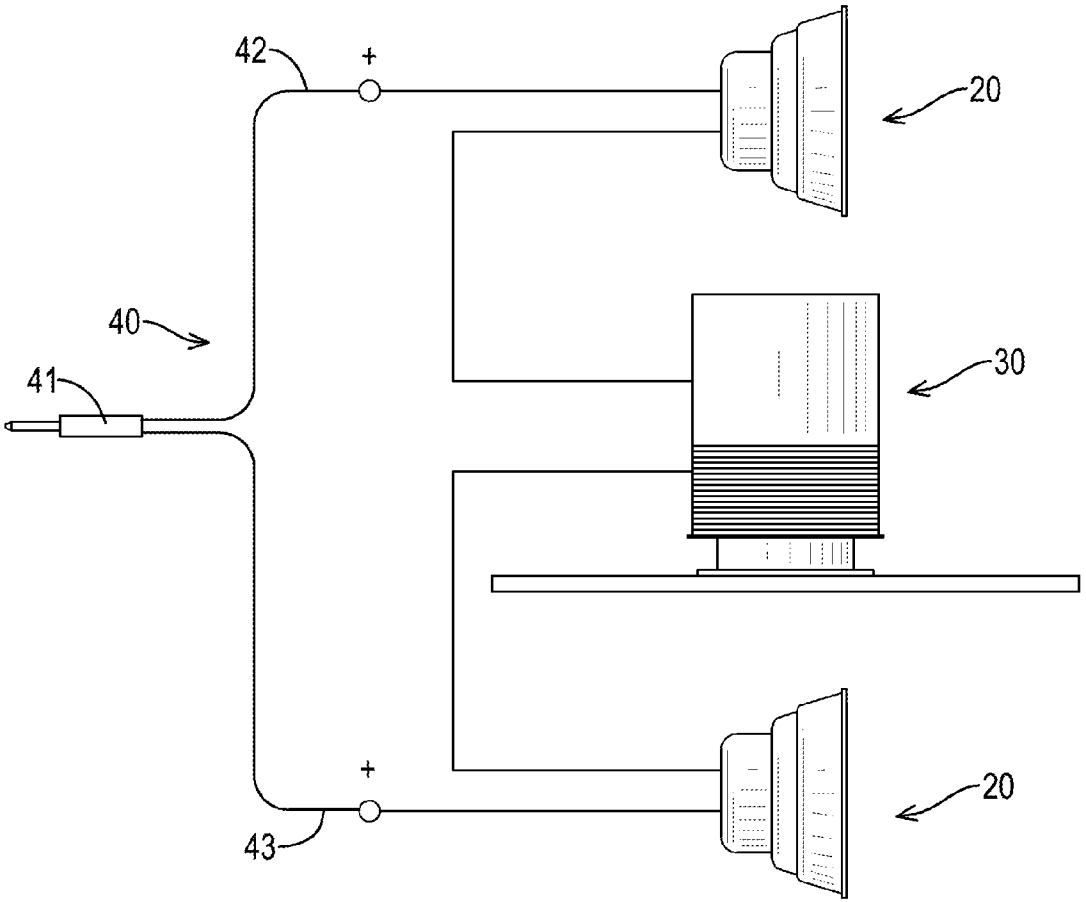
FIG. 6A is a circuit diagram of the full-audio-range speaker in FIG. 5 having an audio cable.
Figure 6B:
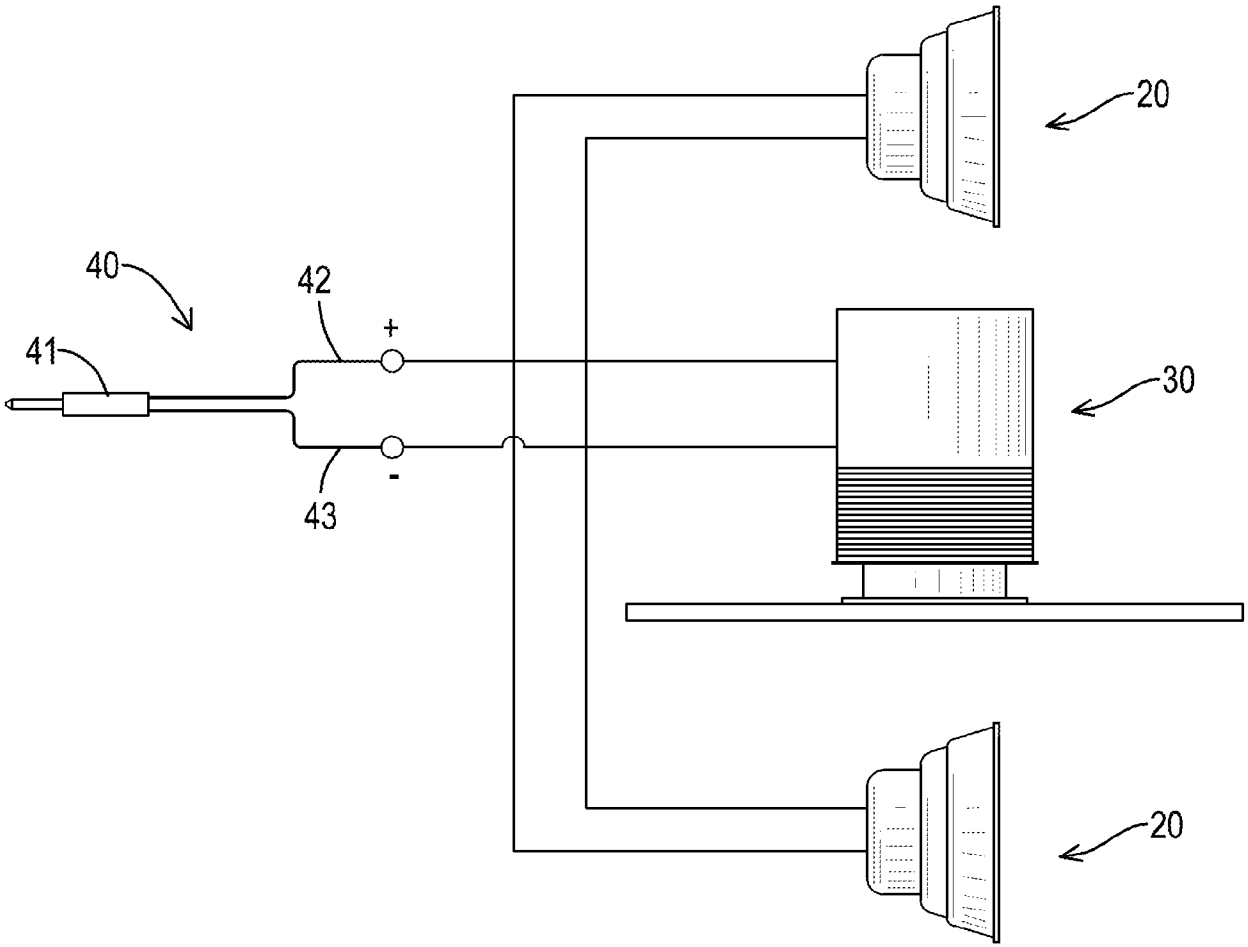
FIG. 6B is another circuit diagram of the full-audio-range speaker in FIG. 5 having an audio cable.

In order to be compatible with a mobile device such as a cell phone, a MP3 or a handheld video game device having only one audio port, with reference to FIGS. 6A and 6B, the second preferred embodiment of the full-audio-range speaker in accordance with the present invention further comprises an audio cable 40 having an audio connecter 41, a signal cable 42 and a ground cable 43.

With reference to FIG. 6A, a connection between the two dynamic speaker units 20, the vibration speaker 30 and the audio cable 40 is shown. The signal cable 42 is electrically connected to the audio connecter 41 and the signal terminal of one of the two dynamic speaker units 20, the ground terminal of said one of the two dynamic speaker units 20 is electrically connected to the signal terminal of the vibration speaker 30. The ground terminal of the vibration speaker 30 is electrically connected to the signal terminal of the other dynamic speaker unit 20, and the ground cable 43 is electrically connected to the audio connecter 41 and the ground terminal of said the other dynamic speaker unit 20, that is, the two dynamic speaker units 20 and the vibration speaker 30 are connected in series.

With reference to FIG. 6B, another connection between the two dynamic speaker units 20, the vibration speaker 30 and the audio cable 40 is shown. The signal cable 42 is electrically connected to the audio connecter 41, the two signal terminals of the two dynamic speaker units 20, and the signal terminal of the vibration speaker 30. The ground cable 43 is electrically connected to the audio connecter 41, the two ground terminals of the two dynamic speaker units 20, and the ground terminal of the vibration speaker 30, that is, the two dynamic speaker units 20 and the vibration speaker 30 are connected in parallel.

Figure 6C:
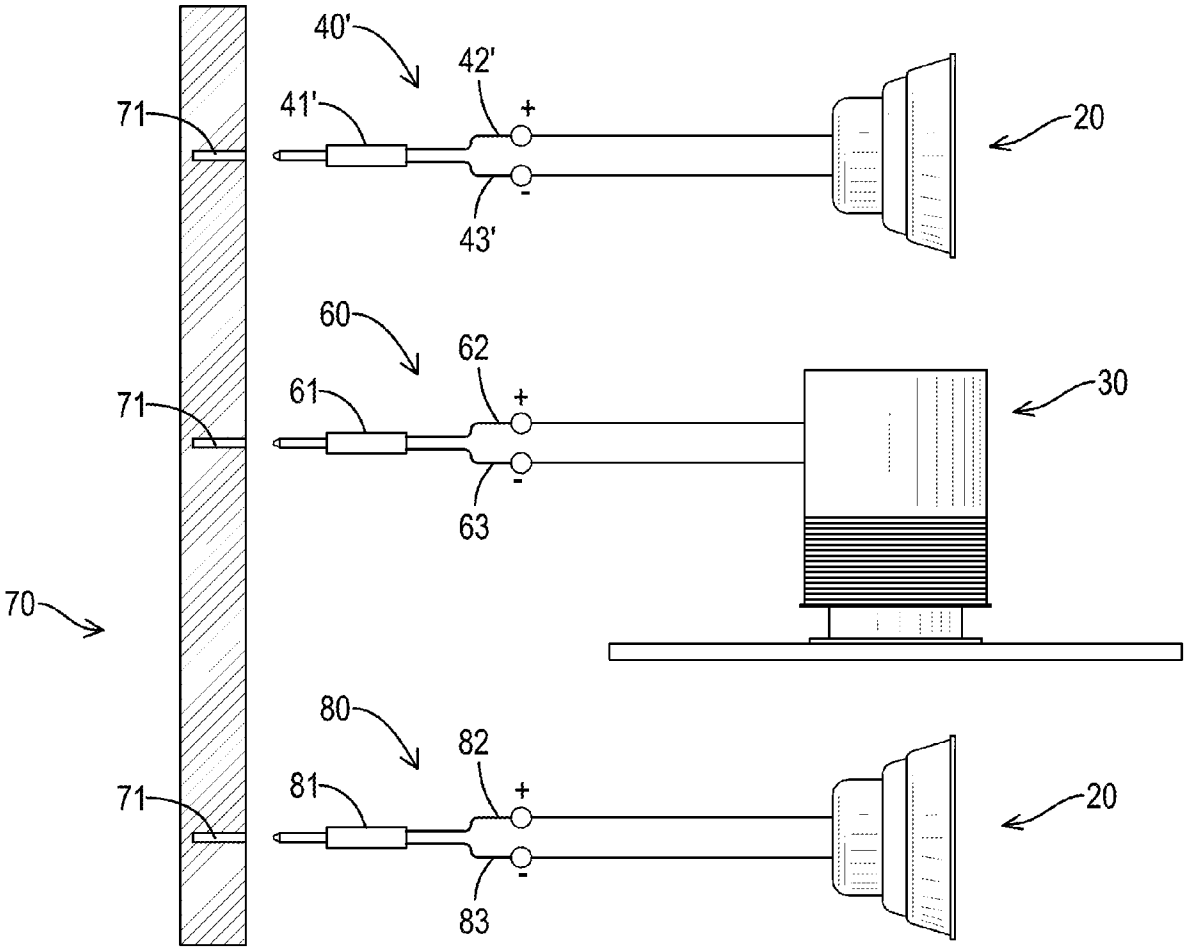
FIG. 6C is another circuit diagram of the full-audio-range speaker in FIG. 5 having three audio cables.

Furthermore, a triple-audio device 70 (2.1 audio interface) is shown in FIG. 6C and has three audio ports 71 to output sounds in three audio channels. In order to be compatible with the triple-audio device 70, the second preferred embodiment of the full-audio-range speaker in accordance with the present invention further comprises a first audio cable 40', a second audio cable 60 and a third cable 80.

The first audio cable 40' has an audio connecter 41', a signal cable 42' and a ground cable 43'. The signal cable 42' is electrically connected to the audio connecter 41' and the signal terminal of one of the two dynamic speaker units 20. The ground cable 43' is electrically connected to the audio connecter 41' and the ground terminal of said one of the two dynamic speaker units 20.

The second audio cable 60 has an audio connecter 61, a signal cable 62 and a ground cable 63. The signal cable 62 is electrically connected to the audio connecter 61 and the signal terminal of the vibration speaker 30. The ground cable 63 is electrically connected to the audio connecter 61 and the ground terminal of the vibration speaker 30.

The third audio cable 80 has an audio connecter 81, a signal cable 82 and a ground cable 83. The signal cable 82 is electrically connected to the audio connecter 81 and the signal terminal of the other dynamic speaker unit 20. The ground cable 83 is electrically connected to the audio connecter 81 and the ground terminal of said the other dynamic speaker unit 20.

By the first audio cable 40', the second audio cable 60 and the third audio cable 80, the two dynamic speaker units 20 and the vibration speaker 30 can respectively receive audio signals from the three audio ports 71 of the triple-audio device 70 to respectively generate sounds in three audio channels.

As shown from the above paragraphs, the second preferred embodiment of the full-audio-range speaker in accordance with the present invention has all advantages of the first preferred embodiment of the full-audio-range speaker. In addition, the second preferred embodiment of the full-audio-range speaker can be further compatible with the triple-audio device 70 by the first audio cable 40', the second audio cable 60 and the third audio cable 80.

In conclusion, the full-audio-range speaker in accordance with the present invention has good performance in all audio ranges by the at least one dynamic speaker unit and the vibration speaker. Furthermore, the bass performance of the full-audio-range speaker is improved by the vibration speaker, and the at least one dynamic speaker unit only needs to focus on midrange and treble performance, that is, the full-audio-range speaker can have good bass performance with a relatively small box compared to a conventional dynamic speaker. Therefore, a volume of the full-audio-range speaker can be further decreased and the speaker can be easily stored and carried by a user.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A full-audio-range speaker comprising:

a box having multiple side walls; and at least one wall hole formed through one of the multiple side walls;

at least one dynamic speaker unit mounted in the box wherein each of the at least one dynamic speaker units has a sound hole aligned with a corresponding wall hole of the at least one wall hole; and a vibration speaker mounted through the box and having a T-shaped base having a pillar mounted through one of the multiple side walls that does not have the at least one wall hole and the pillar having two ends respectively located inside and outside the box; and a bottom board connected to one of the two ends of the pillar that is outside the box.

2. The full-audio-range speaker as claimed in claim 1, wherein the at least one dynamic speaker unit comprises a dynamic speaker unit; and the at least one wall hole of the box comprises a wall hole.

3. The full-audio-range speaker as claimed in claim 2, wherein the dynamic speaker unit further comprises a signal terminal; and a ground terminal;

the vibration speaker further comprises a signal terminal electrically connected to the ground terminal of the dynamic speaker unit; and a ground terminal; and the full-audio-range speaker further comprises an audio cable having an audio connecter;

a signal cable electrically connected to the audio connecter and the signal terminal of the dynamic speaker unit; and a ground cable electrically connected to the audio connecter and the ground terminal of the vibration speaker.

4. The full-audio-range speaker as claimed in claim 2, wherein the dynamic speaker unit further comprises a signal terminal; and a ground terminal;

the vibration speaker further comprises a signal terminal; and a ground terminal; and the full-audio-range speaker further comprises an audio cable having an audio connecter;

a signal cable electrically connected to the audio connecter, the signal terminal of the dynamic speaker unit, and the vibration speaker; and a ground cable electrically connected to the audio connecter, the ground terminal of the dynamic speaker unit, and the ground terminal of the vibration speaker.

5. The full-audio-range speaker as claimed in claim 2, wherein the dynamic speaker unit further comprises a signal terminal; and a ground terminal;

the vibration speaker further comprises a signal terminal; and a ground terminal; and the full-audio-range speaker further comprises a first audio cable having an audio connecter;

a signal cable electrically connected to the audio connecter and the signal terminal of the dynamic speaker unit; and a ground cable electrically connected to the audio connecter and the ground terminal of the dynamic speaker unit; and a second audio cable having an audio connecter;

a signal cable electrically connected to the audio connecter of the second audio cable and the signal terminal of the vibration speaker; and a ground cable electrically connected to the audio connecter of the second audio cable and the ground terminal of the vibration speaker.

6. The full-audio-range speaker as claimed in claim 2, wherein the dynamic speaker unit comprises a speaker housing having a first end, wherein the sound hole is formed at the first end; and a second end;

a first magnet mounted in the second end of the speaker housing and having a first surface facing toward the sound hole; and a second surface;

a first coil mounted on the first surface of the first magnet; and a diaphragm basin mounted in the speaker housing and on the first coil.

7. The full-audio-range speaker as claimed in claim 6, wherein the dynamic speaker unit further comprises a first magneto conductive plate mounted between the first magnet and the first coil.

8. The full-audio-range speaker as claimed in claim 2, wherein the vibration speaker comprises a flexible metal panel mounted on one of the two ends of the pillar that is inside the box;

a second coil mounted on the flexible metal panel; and a second magnet mounted in the second coil.

9. The full-audio-range speaker as claimed in claim 8, wherein the vibration speaker further comprises a metal cap mounted on the second coil.

10. The full-audio-range speaker as claimed in claim 1, wherein the at least one dynamic speaker unit comprises two dynamic speaker units; and the at least one wall hole of the box comprises two wall holes.

11. The full-audio-range speaker as claimed in claim 10, wherein the two wall holes of the box are formed through both sides of said one of the multiple side walls that has the two wall holes; and the vibration speaker is mounted between the two dynamic speaker units.

12. The full-audio-range speaker as claimed in claim 10, wherein each dynamic speaker unit of the two dynamic speaker units further comprises a signal terminal; and a ground terminal;

the vibration speaker further comprises a signal terminal electrically connected to the ground terminal of one of the two dynamic speaker units; and a ground terminal electrically connected to the signal terminal of the other of the two dynamic speaker units; and the full-audio-range speaker further comprises an audio cable having an audio connecter;

a signal cable electrically connected to the audio connecter and the signal terminal of said one of the two dynamic speaker units; and a ground cable electrically connected to the audio connecter and the ground terminal of the other dynamic speaker unit.

13. The full-audio-range speaker as claimed in claim 10, wherein each dynamic speaker unit of the two dynamic speaker units further comprises a signal terminal; and a ground terminal;

the vibration speaker further comprises a signal terminal; and a ground terminal; and the full-audio-range speaker further comprises an audio cable having an audio connecter;

a signal cable electrically connected to the audio connecter, the two signal terminals of the two dynamic speaker units, and the signal terminal of the vibration speaker; and a ground cable electrically connected to the audio connecter, the two ground terminals of the two dynamic speaker units, and the ground terminal of the vibration speaker.

14. The full-audio-range speaker as claimed in claim 10, wherein each dynamic speaker unit of the two dynamic speaker units further comprises a signal terminal; and a ground terminal;

the vibration speaker further comprises a signal terminal; and a ground terminal; and the full-audio-range speaker further comprises a first audio cable having an audio connecter;

a signal cable electrically connected to the audio connecter and the signal terminal of one of the two dynamic speaker units; and a ground cable electrically connected to the audio connecter and the ground terminal of said one of the two dynamic speaker units;

a second audio cable having an audio connecter;

a signal cable electrically connected to the audio connecter of the second audio cable and the signal terminal of the other of the two dynamic speaker units; and a ground cable electrically connected to the audio connecter of the second audio cable and the ground terminal of the other dynamic speaker unit; and a third audio cable having an audio connecter;

a signal cable electrically connected to the audio connecter of the third audio cable and the signal terminal of the vibration speaker; and a ground cable electrically connected to the audio connecter of the third audio cable and the ground terminal of the vibration speaker.

15. The full-audio-range speaker as claimed in claim 10, wherein each dynamic speaker unit of the two dynamic speaker units comprises a speaker housing having a first end, wherein the sound hole is formed at the first end; and a second end;

a first magnet mounted in the second end of the speaker housing and having a first surface facing toward the sound hole; and a second surface;

a first coil mounted on the first surface of the first magnet; and a diaphragm basin mounted in the speaker housing and on the first coil.

16. The full-audio-range speaker as claimed in claim 15, wherein each dynamic speaker unit of the two dynamic speaker units comprises a first magneto conductive plate mounted between the first magnet and the first coil.

17. The full-audio-range speaker as claimed in claim 10, wherein the vibration speaker comprises a flexible metal panel mounted on one of the two ends of the pillar that is inside the box;

a second coil mounted on the flexible metal panel; and a second magnet mounted in the second coil.

18. The full-audio-range speaker as claimed in claim 17, wherein the vibration speaker further comprises a metal cap mounted on the second coil.

19. The full-audio-range speaker as claimed in claim 1, wherein each one of the at least one dynamic speaker unit comprises a speaker housing having a first end, wherein the sound hole is formed at the first end; and a second end;

a first magnet mounted in the second end of the speaker housing and having a first surface facing toward the sound hole; and a second surface;

a first coil mounted on the first surface of the first magnet; and a diaphragm basin mounted in the speaker housing and on the first coil.

20. The full-audio-range speaker as claimed in claim 1, wherein the vibration speaker comprises a flexible metal panel mounted on one of the two ends of the pillar that is inside the box;

a second coil mounted on the flexible metal panel; and a second magnet mounted in the second coil.

* * * * *